US007033205B2

(12) United States Patent
Aihara et al.

(10) Patent No.: US 7,033,205 B2
(45) Date of Patent: Apr. 25, 2006

(54) CONNECTOR WITH A COLLISION PREVENTING PROJECTION

(75) Inventors: Tetsuya Aihara, Yokkaichi (JP); Masahide Hio, Yokkaichi (JP); Atsushi Nishida, Toyota (JP); Masato Minakata, Toyota (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/787,615

(22) Filed: Feb. 26, 2004

(65) Prior Publication Data

US 2004/0171294 A1 Sep. 2, 2004

(30) Foreign Application Priority Data

Feb. 27, 2003 (JP) ..... 2003-051058

(51) Int. Cl.
*H01R 13/64* (2006.01)

(52) U.S. Cl. ..... 439/378; 439/680

(58) Field of Classification Search ..... 439/378, 439/680, 679, 674, 677, 357
See application file for complete search history.

(56) References Cited

U.S. PATENT DOCUMENTS 4,657,331 A * 4/1987 Coldren ..... 439/571
5,425,650 A * 6/1995 Maeda ..... 439/374
5,711,684 A * 1/1998 Inoue et al. ..... 439/354
5,890,931 A * 4/1999 Ittah et al. ..... 439/679
6,319,045 B1 11/2001 Sawayanagi et al. ..... 439/374
6,413,114 B1 * 7/2002 Fukamachi ..... 439/374
6,416,346 B1 * 7/2002 Nakamura ..... 439/374
6,837,750 B1 * 1/2005 Fukuda et al. ..... 439/680
2001/0012717 A1 8/2001 Fukamachi
2003/0096528 A1 5/2003 Fukamachi ..... 439/378

FOREIGN PATENT DOCUMENTS

EP 1 085 612 A1 3/2001
JP 63-141579 9/1988
JP 2001-230021 8/2001

* cited by examiner

*Primary Examiner*—Hae Moon Hyeon
(74) *Attorney, Agent, or Firm*—Gerald E. Hespos; Anthony J. Casella

(57) ABSTRACT

Collision preventing projections (50) are provided on an outer surface of a female housing (20) and will contact an opening of a receptacle (11) of a male housing (10) if a main portion (21) of the female housing (20) is inserted into a receptacle (11) in an oblique posture. Thus, the collision preventing projections (50) ensure that the main portion (21) and male terminals (12) are spaced apart when the main portion (21) is pushed into the receptacle (11) in this oblique posture.

15 Claims, 10 Drawing Sheets

CONNECTOR WITH A COLLISION PREVENTING PROJECTION

BACKGROUND OF THE INVENTION

1. Field of the Invention

The invention relates to a connector with a collision preventing projection.

2. Description of the Related Art

A connector assembly includes male and female connectors. The male connector has a housing with a receptacle and male terminal fittings that project into the receptacle. The female connector has a housing that can be inserted into the receptacle. The female housing may be inclined during insertion into the receptacle. As a result, the front end surface of the female housing can collide with and damage the male terminal fittings.

Japanese Unexamined Utility Model Publication No. S63-141579 discloses a female housing that is intended to avoid collisions with male terminals. Specifically, collision-preventing projections are provided on the outer periphery of the female housing near the front end. The collision-preventing projections contact the opening edge of the receptacle of the male housing if the female housing is inclined during insertion into the receptacle of the male housing. Thus, insertion of the female housing into the receptacle is hindered, and the female housing will not collide with the male terminals. However, the leading ends of the collision preventing projections can enter the receptacle together with an inclined female housing. In such a case, no problem arises if an operator notices this abnormality.

The invention was developed in view of the above problem and to prevent collision with terminals during connection of a connector.

SUMMARY OF THE INVENTION

The invention relates to a connector assembly with first and second connectors. The first connector has a first housing formed with a receptacle. The first connector also has at least one first terminal that projects into the receptacle. The second connector has a second housing and at least one second terminals. A main portion of the second housing can fit properly into the receptacle to connect the first terminal electrically with second terminal. At least one collision preventing projection is provided on an outer surface of the second housing receded from a connecting surface of the main portion. The. collision preventing projection is set to contact and opening edge of the receptacle and hinder connection when the main portion is inserted into the receptacle at a posture oblique to a proper connecting posture. Thus, the collision preventing projection will be at the outer side of the opening of the receptacle without entering the opening. The main portion of the second housing and the first terminals are spaced apart when the collision preventing projection contacts the opening edge of the receptacle. Accordingly, the second housing will not collide with the first terminals.

In contrast to the invention, an operator can forcibly push the female housing of the above-mentioned known connector into the receptacle without noticing the abnormality. The female housing can widen the receptacle and be inserted toward the back side. Consequently, the female housing of the known connector can collide with and damage the male terminals, and the intended function of the collision preventing projections on the known connector may not be exhibited completely. This problem is particularly likely if the known connector has a wide receptacle where many contacts are to be established. In this situation, the insertion of the female housing in its inclined posture is permitted easily due to an easily deformable construction of the receptacle.

The front end of the collision preventing projection preferably is undercut at an acute angle to a connecting direction. Thus, the front end surface of the collision preventing projection bites in the opening edge of the receptacle after collision and prevents further insertion of the main portion.

A distance D by which the collision preventing projection is spaced from the connecting surface preferably is set to substantially satisfy a relational expression: $H \leqq D < B$ where H denotes the height of the opening of the receptacle and B denotes a distance between the leading end of the male terminal and an opening plane of the receptacle.

At least one guide preferably is provided in the receptacle for guiding the insertion of the connection preventing projection.

At least one auxiliary collision preventing projection preferably is provided on an outer surface of the main portion different than the outer surface where the collision preventing projection is provided.

At least one auxiliary guide preferably is provided for guiding the insertion of the corresponding auxiliary connection preventing projection.

The auxiliary collision preventing surface preferably is at a position along the fitting direction that is closer to the connecting surface than the collision preventing projections.

Two collision preventing projections preferably are provided at opposite ends of the outer surface of the main portion.

The collision preventing projection preferably is on the outer side of the main portion that has a lock arm for locking the two properly connected housings together.

These and other features of the invention will become more apparent upon reading the following detailed description of preferred embodiments and accompanying drawings. It should be understood that even though embodiments are described separately, single features may be combined.

DETAILED DESCRIPTION OF THE PREFERRED EMBODIMENTS

Figure 1:
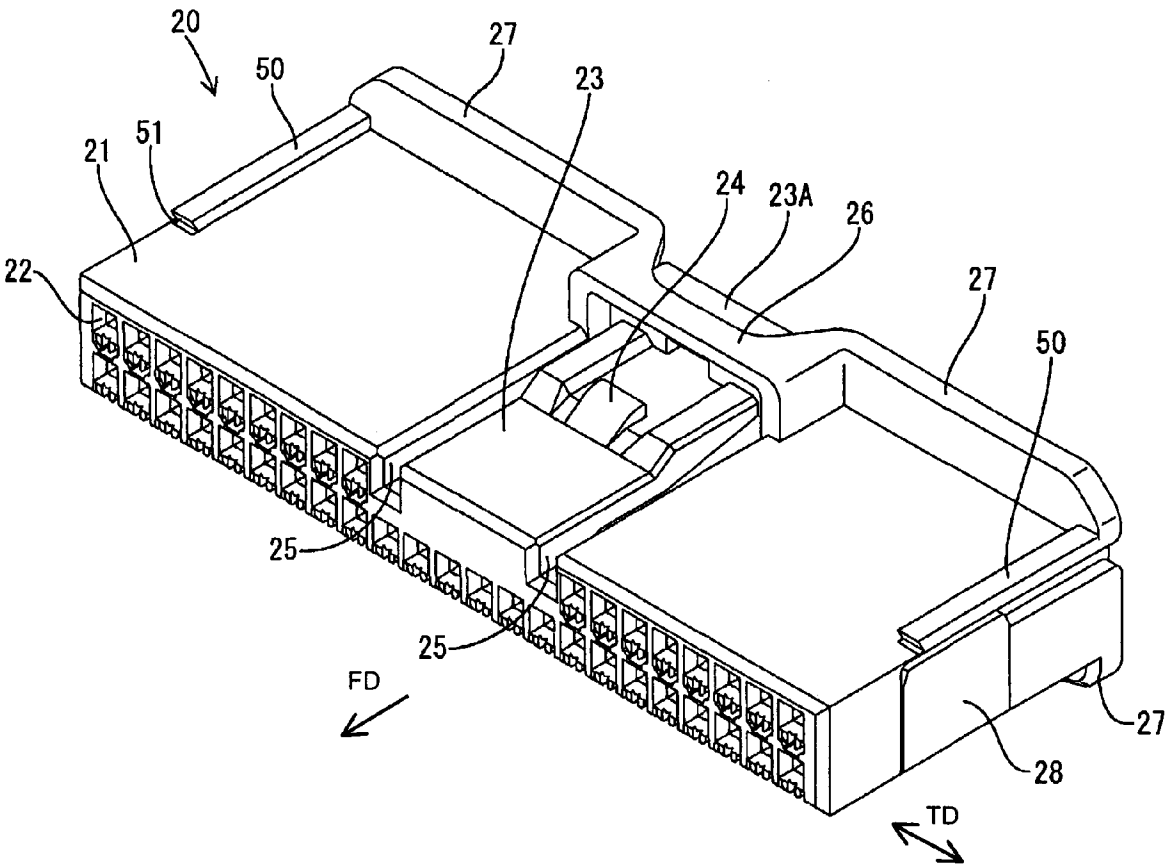
FIG. 1 is a perspective view of a female housing according to a first embodiment of the invention.
Figure 2:
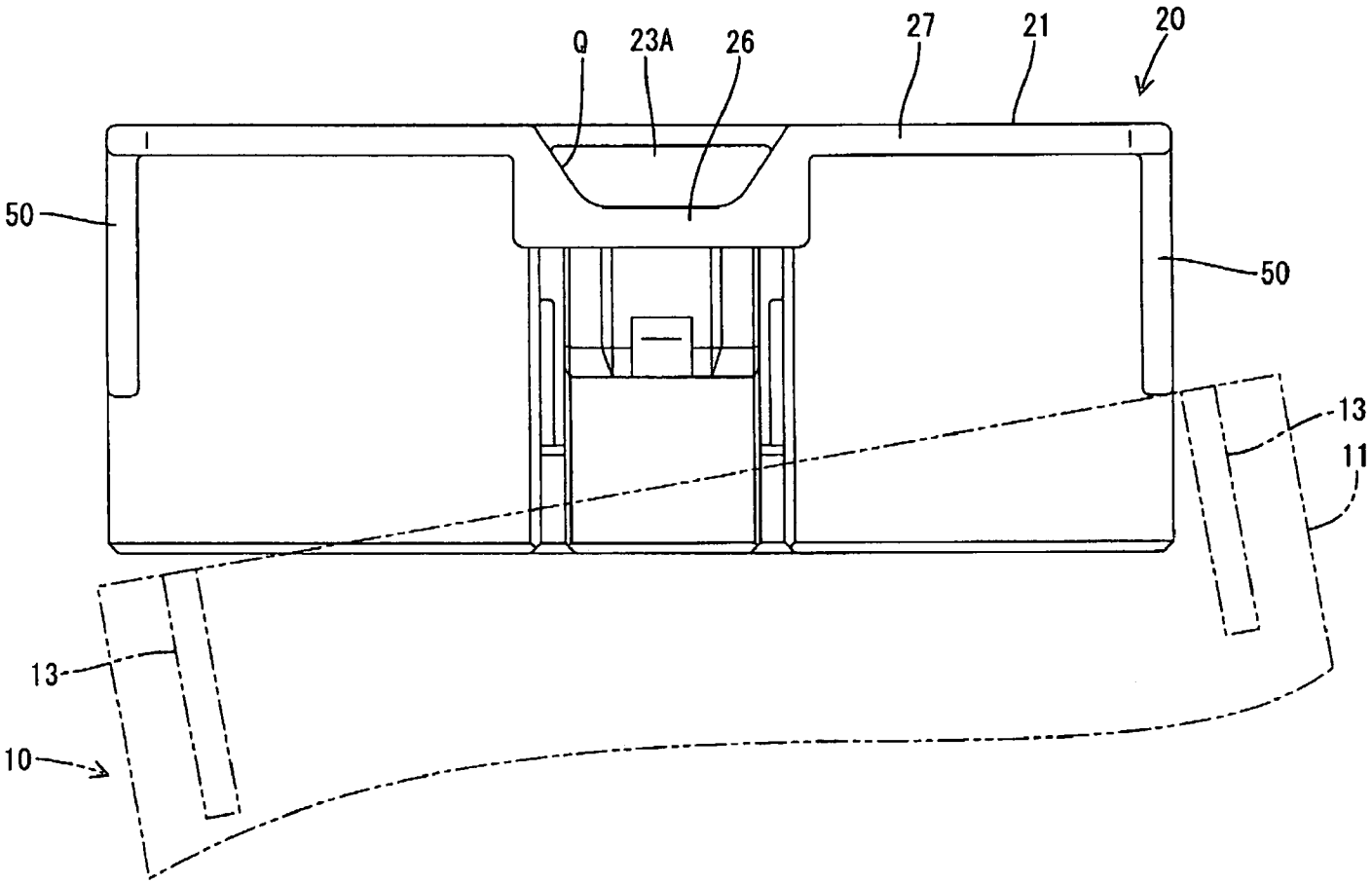
FIG. 2 is a plan view of the female housing.

A connector of a first embodiment has a male housing 10 and a female housing 20, as shown in FIGS. 1–8. The male housing 10 has a receptacle 11 and male terminals 12 project into the receptacle 11. Female terminals (not shown) are accommodated in the female housing 20. The male and female terminals are connected electrically by properly fitting the female housing 20 into the receptacle 11 of the male housing 10 along a fitting direction FD. In the following description, ends of the male and female housings 10, 20 to be connected with each other are referred to as the front.

Figure 5:
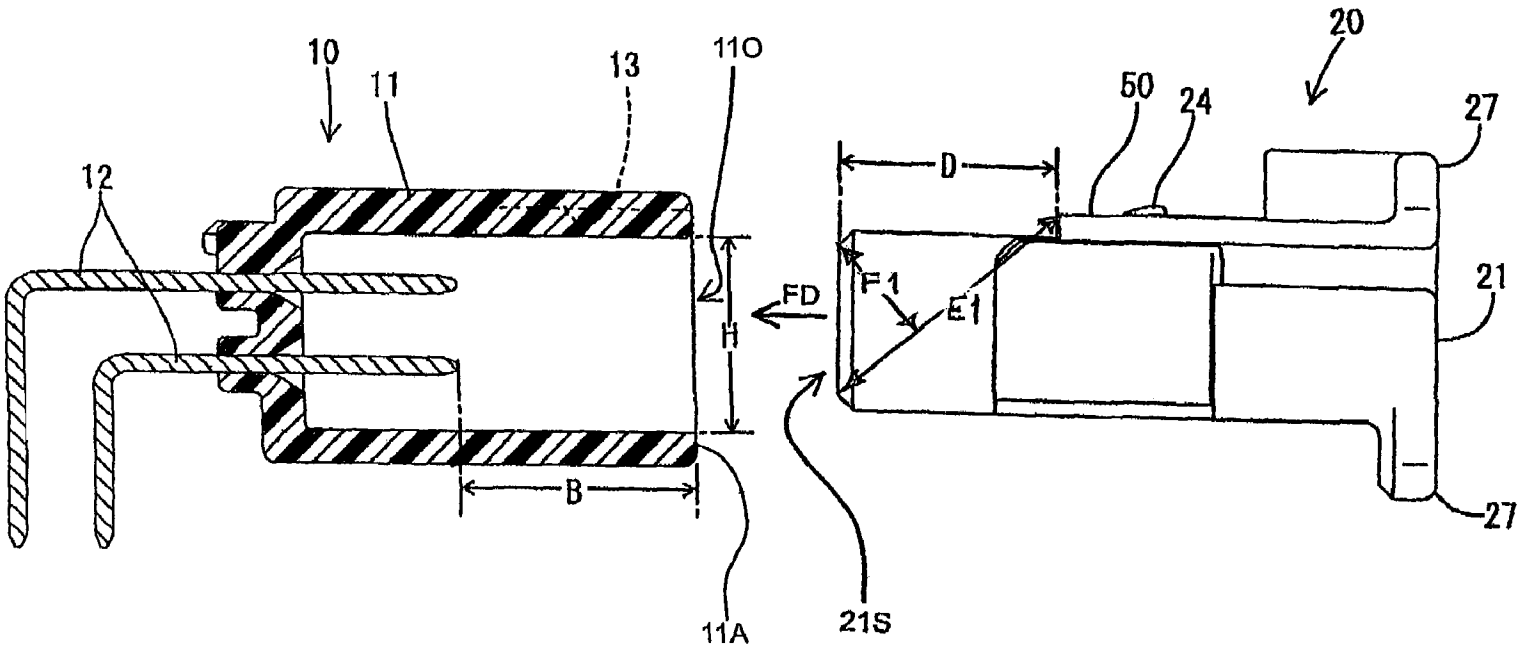
FIG. 5 is an exploded side elevational view, partly in section showing a state before the female housing is connected with a male housing.

The male housing 10 preferably is to be mounted on an unillustrated printed circuit board and, as shown in FIG. 5, the receptacle 11 is a wide substantially rectangular tube having an open front end. Male terminals 12 project at upper and lower levels in the receptacle 11 so that the terminals 12 in each level are arranged in a transverse direction TD substantially normal to the fitting direction FD. Each male terminal 12 is bent substantially normal to the fitting direction FD to define a substantially L-shape. One end of each male terminal 12 is located in the receptacle 11 for connection with a female terminal. A more rearward portion of each male terminal 12 is drawn substantially parallel to the fitting direction FD through the back wall of the receptacle 11 and is bent down at an intermediate position for connection with a printed circuit on the circuit board e.g. by soldering, welding, ultrasonic welding, clamping, etc. Guiding grooves 13 are formed in the inner wall of the receptacle 11 and extend substantially along the fitting direction FD.

The female housing 20 has a wide rectangular main portion 21, as shown in FIG. 1. Cavities 22 penetrate the main portion 21 forward and backward substantially along the fitting direction FD and correspond to the respective male terminals 12 of the male housing 10. Female terminals can be accommodated in the respective cavities 22.

Figure 3:
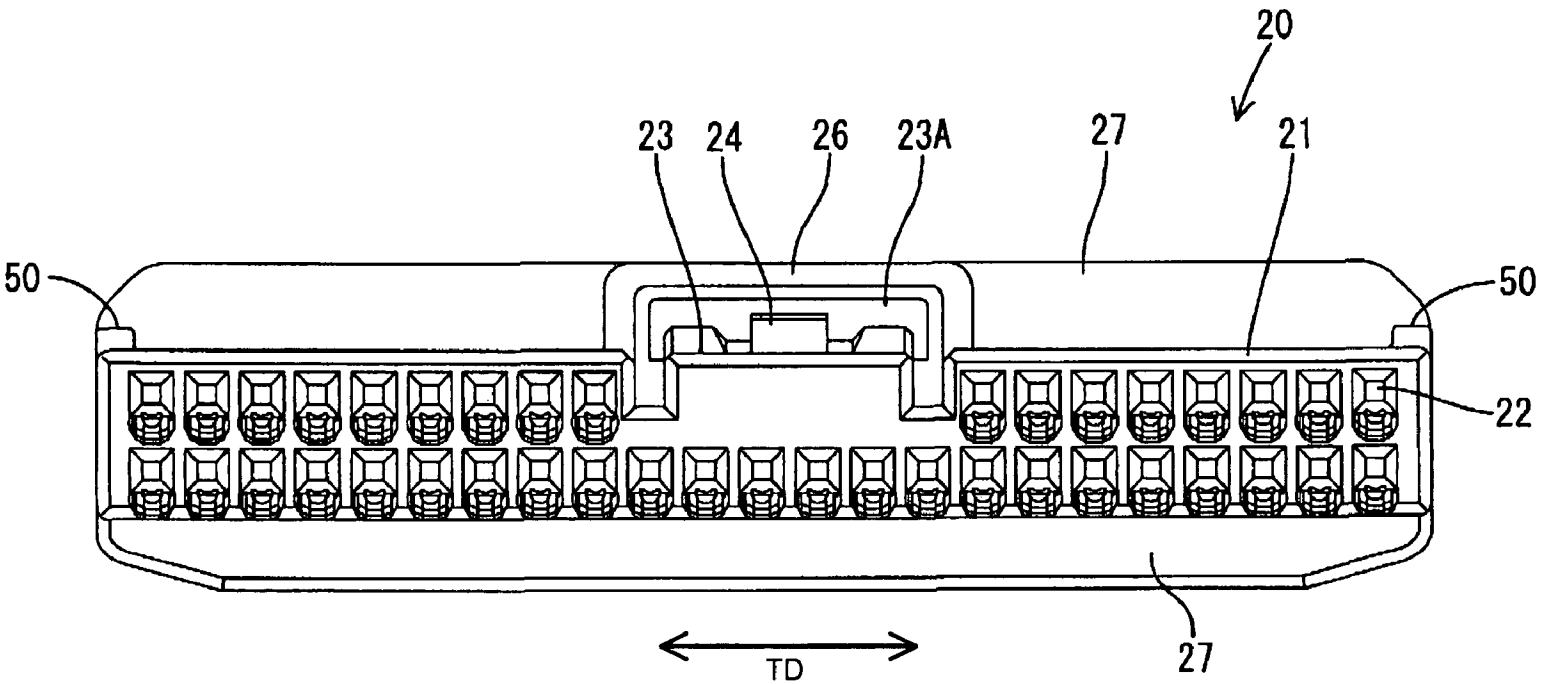
FIG. 3 is a front view of the female housing.
Figure 4:
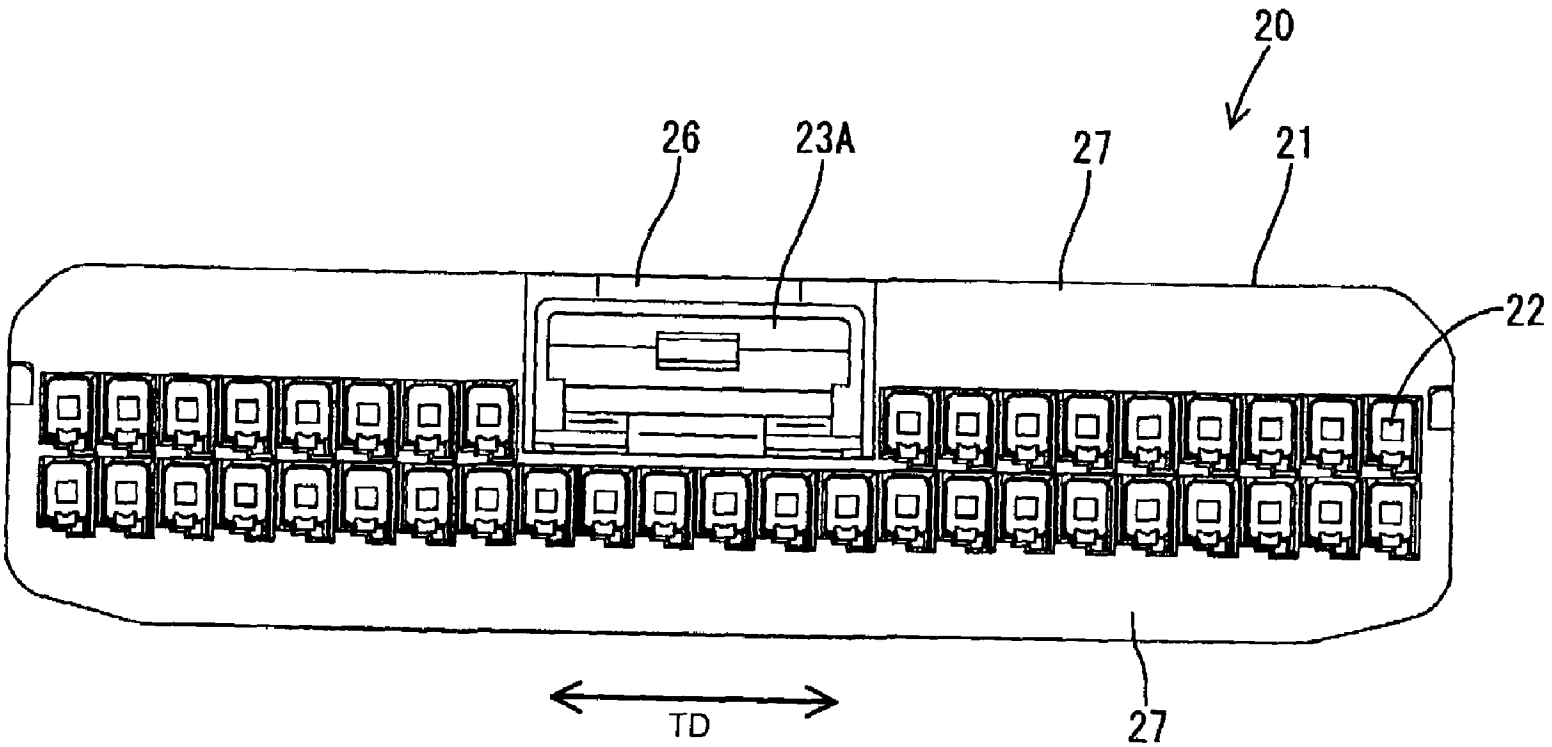
FIG. 4 is a rear view of the female housing.

A resiliently deformable lock arm 23 is formed at the widthwise middle of the upper surface of the main portion 21 and is cantilevered backward from the front surface substantially along the fitting direction FD. A lock 24 projects from the upper surface of the lock arm 23. Grooves 25 are formed at the outer sides of the lock arm 23 and separate the lock arm 23 from the main portion 21. The upper surface of a base-end side of the lock arm 23 is substantially at the same height as the upper surface of the main portion 21 across the grooves 25, as shown in FIG. 3. Thus, the lock arm 23 enters the receptacle 11 when the main portion 21 is fit into the receptacle 11 and deforms resiliently. The lock 24 fits into a receiving portion (not shown) in the inner wall of the receptacle 11 when the main portion 21 reaches a proper connection position where both female and male terminals are connected electrically. As a result that the main portion 21 is locked so as not to come out.

The rear end of the lock arm 23 defines an operable portion 23A, and a gate 26 near the rear end of the upper surface of the main portion 21 covers part of the operable portion 23A from above so that an external force cannot inadvertently unlock the lock arm 23. The gate 26 is cut to define an operation space Q for intentionally deforming the operable portion 23A (see FIG. 2).

Ribs 27 bulge out rear end positions of the upper and lower surfaces of the main portion 21. The widthwise middle of the upper rib 27 is integral and substantially continuous with the gate 26. The rear surfaces of both ribs 27 function as operable surfaces for inserting and withdrawing the main portion 21 into and from the receptacle 11. A side retainer 28 is mountable in one side surface of the main portion 21 for locking the female terminals.

Collision preventing projections 50 project at the opposite widthwise sides of the top surface of the main portion 21 and extend substantially along the fitting direction ED. The collision preventing projections 50 prevent improper or upside-down insertion. Rear ends of the collision preventing projections 50 are coupled to the upper rib 27. Front ends of the collision preventing projections 50 are receded from the front end 21S of the main portion 21 along the fitting direction FD by a distance D (see FIG. 5). However, the front ends of the collision preventing projections 50 extends sufficiently forward to be substantially adjacent at least parts of the side retainer 28 as shown in FIGS. 1 and 5–10. Additionally, front end surfaces of the collision preventing projections 50 overhang to define undercut surfaces 51 that are aligned at an acute angle to the fitting direction FD.

Figure 6:
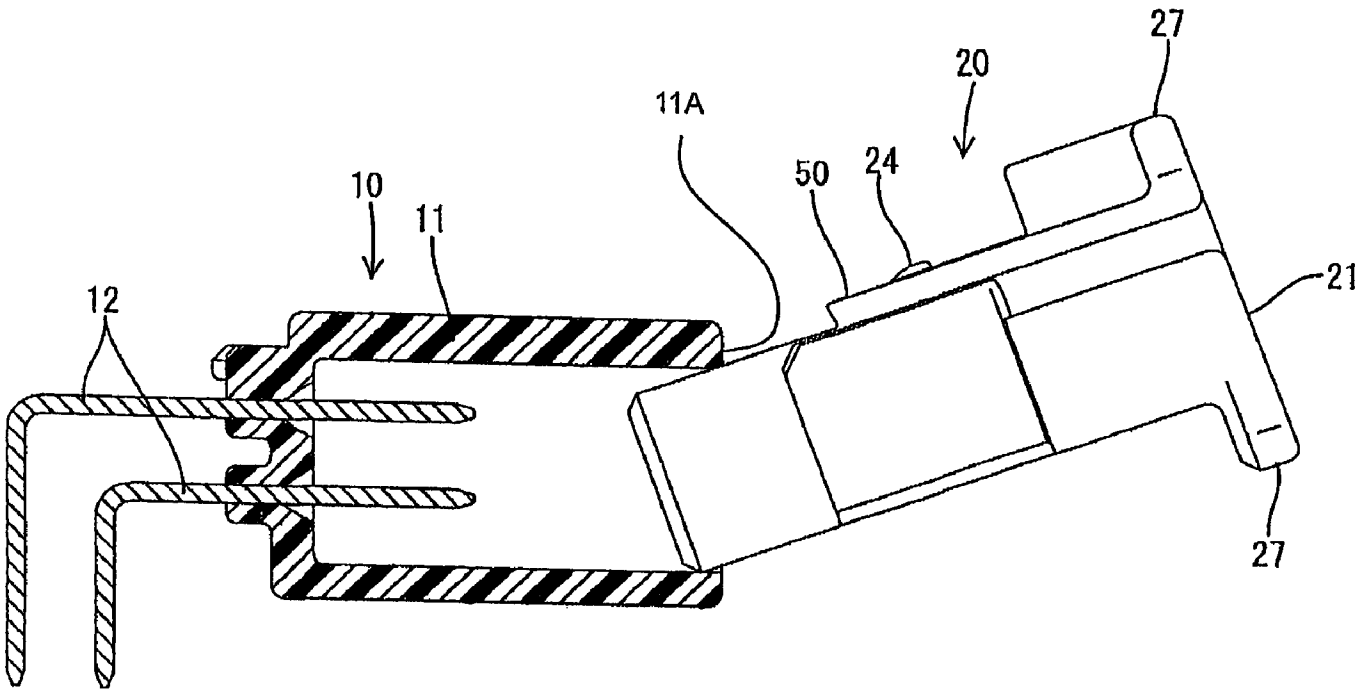
FIG. 6 is a view showing similar to FIG. 5, but showing the female housing being fit into a receptacle in an oblique posture.

The collision preventing projections 50 slide in the corresponding guiding grooves 13 formed in the inner wall of the receptacle 11 when the main portion 21 is fit into the receptacle 11 in a proper connecting posture. However, an attempt can be made to insert the main portion 21 into the receptacle 11 in a posture oblique to the proper connecting posture, as shown in FIG. 6. In this situation, the front end 21S of the main portion 21 enters the receptacle 11, but the upper and lower surfaces main portion 21 contact the inner walls at the opening 11O of the receptacle 11 and hinder the inserting operation. At this time, the collision preventing projections 50 are outside the opening 11O of the receptacle 11 and prevent insertion of the receptacle 11 into the opening 11O as long as the main portion 21 takes a posture other than the substantially proper connecting posture.

The main portion 21 can be moved towards a proper connecting posture and may start to widen the receptacle 11 and may enter the receptacle 11 due to pushing forces on the main portion 21. However, the collision preventing projections 50 then contact with the opening edge 11A of the receptacle 11. More particularly, the collision preventing projections 50 engage the opening edge 11A over the entire height of the collision preventing projections 50 shortly after the front end of the main portion 21 enters the receptacle 11, thereby hindering any further insertion (see FIGS. 2 and 7). In this state, there is a space between the main portion 21 and the male terminals 12 and, therefore, there is no possibility of colliding with the male terminals 12. The posture of the main portion 21 can be corrected to the proper connecting posture after the connecting operation of the main portion 21 is temporarily hindered. Thus, the connecting operating may progress further and the main portion 21 can reach the proper connection position.

In this way, the collision preventing projections 50 are at the outer side of the opening 11O of the receptacle 11 when the connecting operation is hindered and contact the opening edge 11A of the receptacle 11 before the main portion 21 contacts the male terminals 12. The distance D by which the collision preventing projections 50 are receded on the outer surface of the main portion 21 from the front end 21S is set to satisfy a relational expression: $H \leqq D < B$ where H is the height of the opening 11O of the receptacle 11 and B is a distance between the leading ends of the male terminals 12 and the opening plane of the receptacle 11 (see FIG. 5). The thus set distance D guarantees such positions of the collision preventing projections 50 that the collision preventing projections 50 do not enter the opening 11O of the receptacle 11 even if the main portion 21 takes such an abnormal posture standing substantially at a right angle to the proper connecting posture (H≦D) and the main portion 21 and the male terminals are always distanced from each other when the collision preventing projections 50 contact the opening edge 11A of the receptacle (D<B). The position of the upper front corners of the collision preventing projection 50 relative to the front corners of the female housing 20 is illustrated in FIG. 5. In particular, the front corners of the collision preventing projections 50 are spaced from an intersection of the front surface 21S with the lower outer surface by a distance E1 selected to satisfy a relational expression E1>H. Additionally a line connecting the front corner of the collision preventing projection 50 and an intersection of the front surface 21S with lower surface of the main portion 21 is spaced from an intersection of the front surface 21S with the upper surface of the main portion 21 by a minimum distance F1 selected to satisfy a relational expression F1<B, as shown in FIG. 5.

The receptacle 11 of the male housing 10 and the main portion 21 of the female housing 20 can be disposed so that the connecting surfaces thereof substantially face each other. The main portion 21 then is fit at least partly into the receptacle 11 in this state. The main portion 21 can be inserted smoothly in the fitting direction FD to the back in the receptacle 11 and to the proper connection position if the main portion 21 is in the proper connecting posture. However, a main portion 21 that takes a posture oblique to the proper connecting posture will contact with the opening 11O and/or opening edge 11A of the receptacle 11 to temporarily hinder the connecting operation (see FIG. 6). The collision preventing projections 50 will contact with the opening edge 11A of the receptacle 11 if the main portion 21 is pushed further, thereby securely hindering any further insertion (see FIGS. 2 and 7). The main portion 21 and the male terminals 12 are spaced apart in this state, and hence there is no possibility of colliding with the male terminals 12.

As described above, the collision preventing projections 50 are provided at the positions receded from the connecting surface 21S of the main portion 21 sufficiently to satisfy the relational expression (H≦D<B). Thus, unlike the prior art, the collision preventing projections 50 cannot enter the receptacle 11 together with the main portion 21 even if the main portion 21 is fit into the receptacle 11 at a posture oblique to the proper connecting posture,. Therefore, the main portion 21 cannot collide with the male terminals 12.

Figure 7:
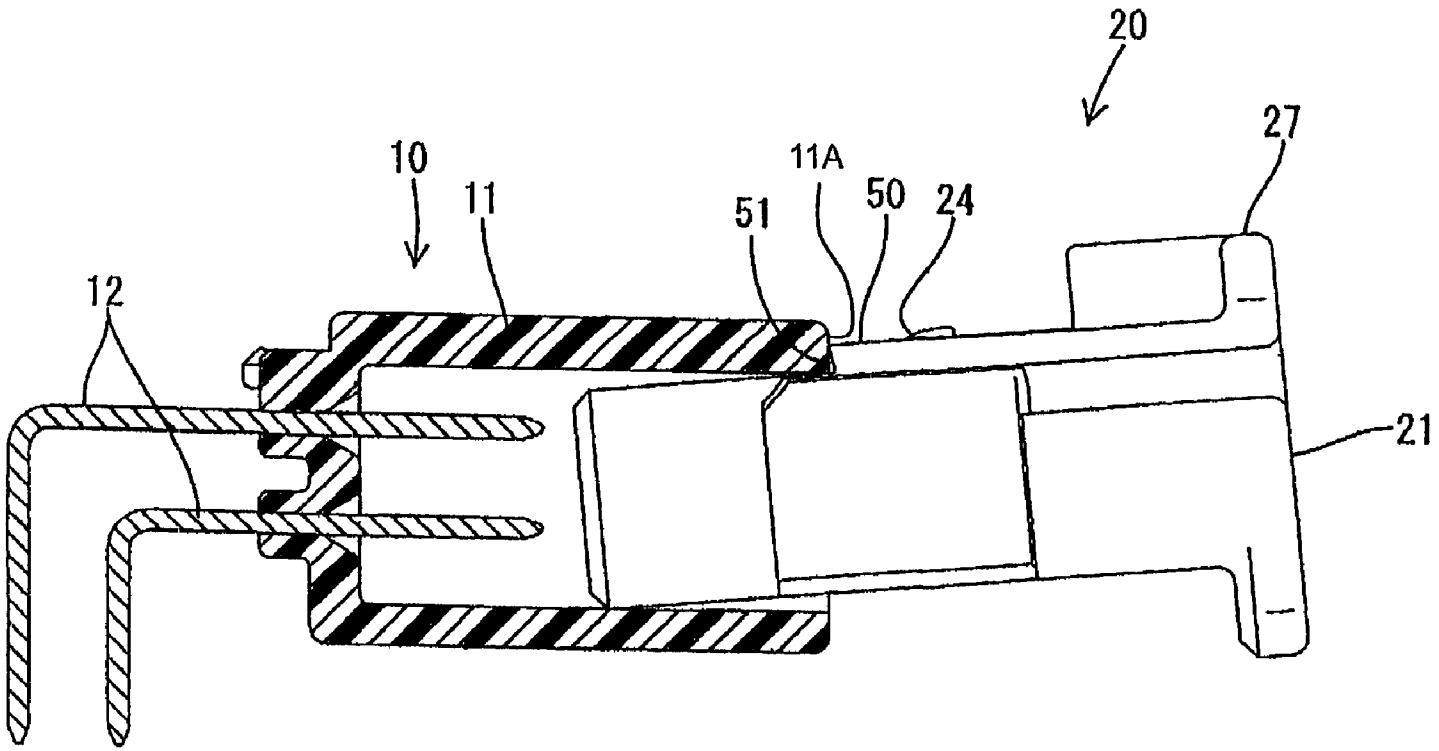
FIG. 7 is a view similar to FIG. 6, but showing a state where collision preventing projections contact the opening edge of the receptacle.
Figure 8:
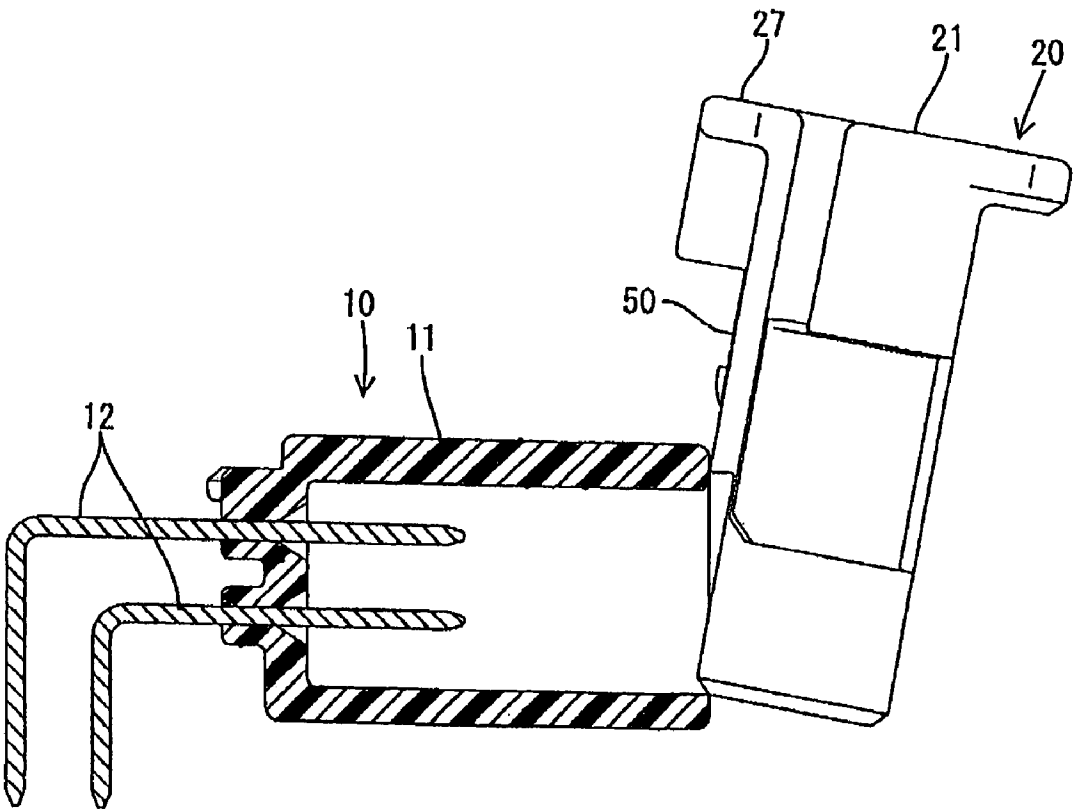
FIG. 8 is a view similar to FIGS. 5–7, but showing the female housing at substantially a right angle to a proper posture.

Further, the overhanging surfaces 51 at the front ends of the collision preventing projections 50 are aligned at acute angles to the fitting direction FD (e.g. as shown in FIG. 7). Thus, the collision preventing projections 50 bite in or plastically deform the opening edge 11A of the receptacle 11 and any further insertion of the main portion 21 is hindered to more securely prevent collision of the main portion 21 with the male terminals 12.

Figure 9:
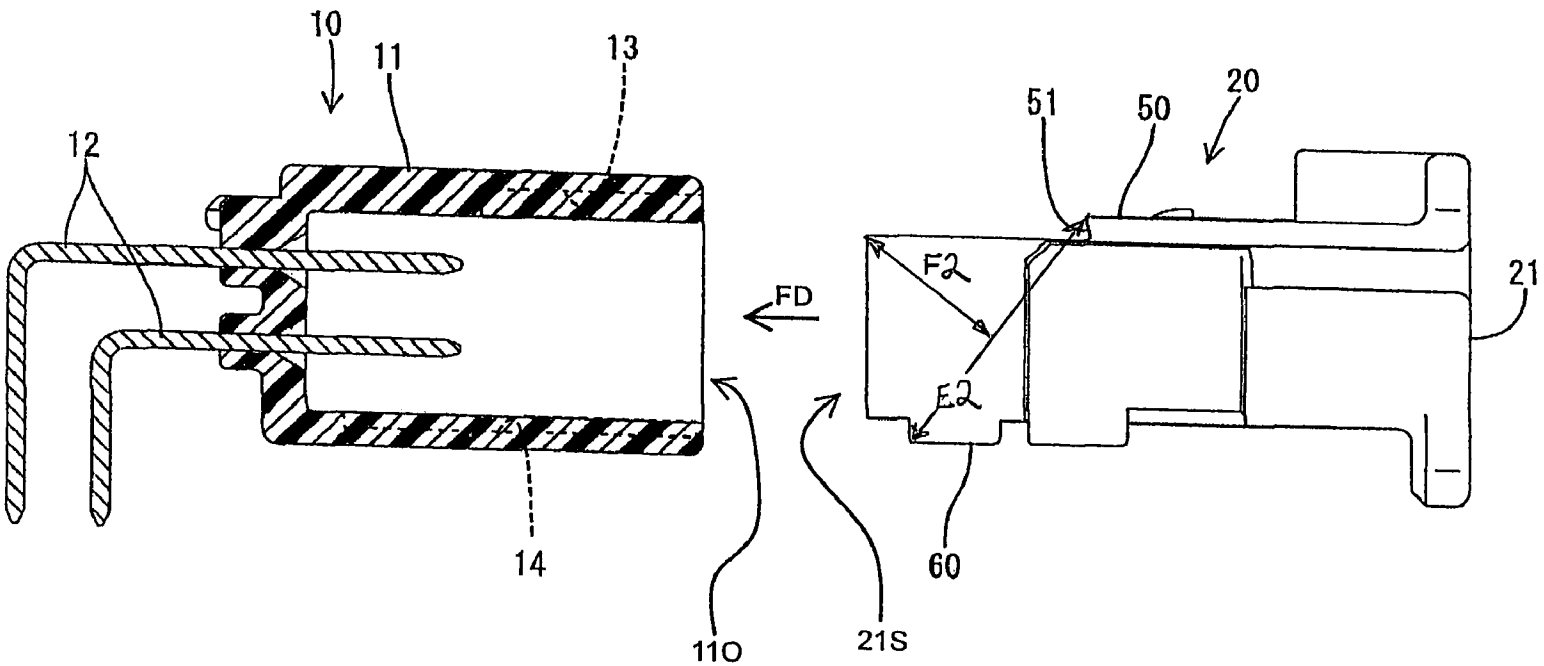
FIG. 9 is a cross-sectional view similar to FIG. 5, but showing a second embodiment of the invention.
Figure 10:
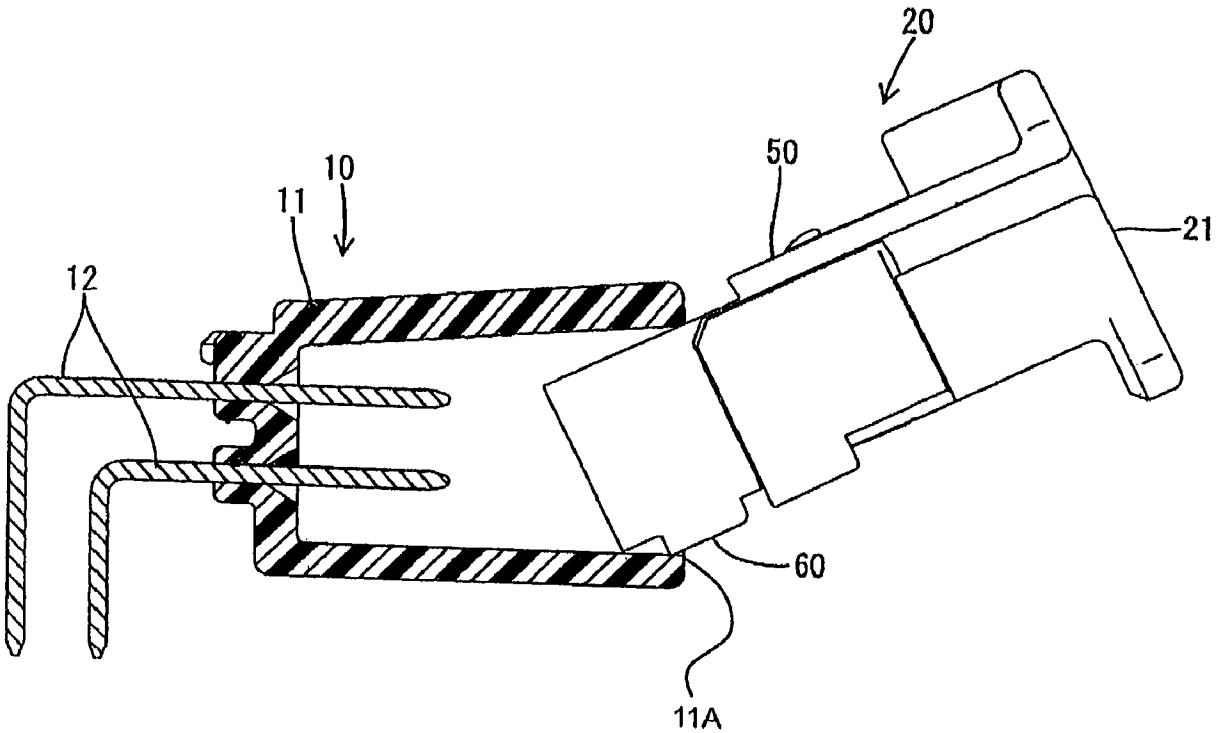
FIG. 10 is a cross-sectional view similar to FIG. 6, but showing the second embodiment.

A second embodiment of the invention is described with reference to FIGS. 9 and 10. The second embodiment mainly differs from the first embodiment in that at least one connection preventing projections 60 is provided on the surface of the main portion 21 opposite from the surface with the collision preventing projections 50. No repetitive description is given for elements that are similar to the first embodiment, and those similar structural parts merely are identified by the same reference numerals.

The connection preventing projections 60 of the second embodiment are at opposite sides of the bottom surface of the main portion 21, and hence opposite the side where the lock 24 is provided. Additionally, front end positions of the connection preventing projections 60 are closer to the connecting surface 21S than the front ends of the collision preventing positions 50. The connection preventing projections 60 are inserted along guiding grooves 14 in the inner wall of the receptacle 11 when the main portion 21 is fit into the receptacle 11 in a proper connecting posture.

The main portion 21 may be fit into the receptacle 11 with a posture oblique to the proper connecting posture. In this situation, the connection preventing projections 60 contact the inner surfaces of the opening 11O of the receptacle 11 and widen the opening 11O (see FIG. 10). In this state, the collision preventing projections 50 are outside of the opening 11O without entering the receptacle 11. Further in this state, the opening 11O of the receptacle 11 resists against a pushing force by the connection preventing projections 60, and an operator has notice that the main portion 21 is not in the proper connecting posture. However, if the operator forcibly pushes the main portion 21 without noticing this, the collision preventing projections 50 then contact the opening edge 11A of the receptacle 11 to securely hinder the insertion of the main portion 21.

The connection preventing projections 61 hinder insertion of the main portion 21 unless the main portion 21 is oriented properly. The collision preventing projections 50 securely hinder insertion even if the connection preventing projections 60 fail to hinder insertion. Thus, the collision of the main portion 21 with the male terminals 12 is prevented more securely. The collision preventing projections 50 are spaced from front corners of the connection preventing projection 60 by a distance E2 selected to satisfy a relational expression E2>H, as shown in FIG. 10. Additionally, a line connecting the front corners of the collision preventing projection 50 and the connection preventing projection 60 is spaced from an intersection of a front surface 21S with the top surface of the main portion 21 by a minimum distance F2 to satisfy the relational expression F2<B, as shown in FIG. 10.

The invention is not limited to the above described and illustrated embodiments and the following embodiments also are embraced by the invention as defined by the claims. Other changes also can be made without departing from the scope of the invention as defined by the claims.

The present invention is applicable not only to circuit board connectors, but also to ordinary connectors.

In the case that the opening of the receptacle is vertically long, the collision preventing projections preferably are receded from the connecting surface of the main portion by a distance longer than the width of the opening.

What is claimed is:

1. A connector, comprising:

a first housing with a receptacle with an opening having a height H, first terminals mounted in the first housing and having front ends projecting into the receptacle, the front ends of the first terminals being spaced rearwardly from the opening by a distance B;

a second housing having a main portion with a front surface, portions of the main portion extending rearward from the front surface being dimensioned for insertion into the receptacle of the first housing when the first and second housings are aligned at a proper connecting posture; and:

at least one collision preventing projection at a position of an outer surface of the second housing reward of the front surface of the main portion by a distance D selected to satisfy a relational expression:

$$H \leqq D < B$$

such that the collision preventing projection contacts the opening from outside the receptacle and hindering a connecting operation when the first and second housings are at a posture oblique to a proper connecting posture.

2. The connector of claim 1, wherein the front end surface of the collision preventing projection comprises an overhanging surface aligned at an acute angle to a connecting direction.

3. The connector of claim 2, wherein at least one guiding groove is provided in the receptacle for guiding insertion of the connection preventing projection.

4. The connector of claim 1, further comprising auxiliary collision preventing projections on an outer surface of the main portion substantially opposite the outer surface where the collision preventing projections are provided, auxiliary guiding grooves formed in the receptacle for guiding insertion of the corresponding auxiliary connection preventing projections, the auxiliary collision preventing projection being at positions along a filling direction closer to the connecting surface than the collision preventing projections.

5. A connector, comprising:

a first housing with a receptacle having an opening, first terminals mounted in the first housing and having front ends projecting into the receptacle, the front ends of the first terminals being spaced rearwardly from the opening by a distance B, guiding grooves provided in a first surface of the receptacle and auxiliary guiding grooves formed in a second surface of the receptacle, the second surface of the receptacle being substantially opposed to the first surface thereof;

a second housing having a main portion with a front surface, sections of the main portion extending rearward from the front surface being dimensioned for insertion into the receptacle of the first housing when the first and second housings are aligned at a proper connecting posture, collision preventing projections on a first outer surface of the second housing rearward of the front surface of the main portion by a distance D, auxiliary collision preventing projection on a second outer surface of the main portion substantially opposite the first outer surface and being spaced rearward from the front surface by a distance less than the distance D, and wherein the collision preventing projection are disposed to satisfy a relational expression:

$$D<B$$

such that at least one of the collision preventing projections and the auxiliary collation preventing projections contact the opening from outside the receptacle and hinder a connecting operation when the first and second housings are at a posture oblique to a proper connecting posture.

6. The connector of claim 5, wherein the front end surface of the collision preventing projection comprises an overhanging surface aligned at an acute angle to a connecting direction.

7. The connector of claim 5, wherein a distance D by which the collision preventing projection is spaced from the connecting surface is set to substantially satisfy a relational expression:

$$H \leq D<B$$

where H denotes the height of the opening of the receptacle.

8. The connector of claim 5, wherein two of the collision preventing projections are provided respectively at opposite sides of the first outer surface of the main portion.

9. The connector of claim 5, further comprising a lock arm on the outer surface of the main portion that has the collision preventing projections, the lock arm being configured for locking the two properly connected connector housings together.

10. A connector, comprising:

a first housing with a receptacle having an opening, a guiding groove formed in a first surface of the receptacle, first terminals mounted in the first housing and having front ends projecting into the receptacle, the front ends of the first terminals being spaced rearwardly from the opening by a distance B;

a second housing having a main portion with a front surface, sections of the main portion extending rearward from the front surface being dimensioned for insertion into the receptacle of the first housing when the first and second housings are aligned at a proper connecting posture, collision preventing projections on a first outer surface of the second housing reward of the front surface of the main portion by a distance D, a retainer mounted to at least a second outer surface of the second housing, wherein:

the collision preventing projections adjacent at least parts of leading ends of the retainer, and the distance D is selected to satisfy a relational expression:

$$D<B$$

such that the collision preventing projections contact the opening from outside the receptacle and hindering a connecting operation when the first and second housings are at a posture oblique to a proper connecting posture.

11. The connector of claim 10, wherein auxiliary collision preventing projections are provided on an outer surface of the main portion different than the outer surface where the collision preventing projections are provided.

12. The connector of claim 11, wherein auxiliary guiding portions are provided for guiding the at least partial insertion of the corresponding auxiliary connection preventing projections.

13. The connector of claim 12, wherein the auxiliary collision preventing projections are between the retainer and the connecting surface.

14. A connector, comprising:

a first housing with a receptacle having an opening, the receptacle having opposite first and second surfaces defining a height H for the receptacle, a guiding groove formed in the first surface of the receptacle, first terminals mounted in the first housing and having front ends projecting into the receptacle, the front ends of the first terminals being spaced rearwardly from the opening by a distance B;

a second housing having a main portion with a front surface, first and second outer surfaces extending rearward from the front surface and being dimensioned for insertion into the receptacle of the first housing when the first and second housings are aligned at a proper connecting posture, collision preventing projections on the first outer surface of the second housing reward of the front surface of the main portion, the collision preventing projections having front corners spaced outwardly from the first surface, the front corners of the collision preventing projections being spaced from an intersection of the front surface with the second outer surface by a distance E1 selected to satisfy a relational expression:

$$E1>H$$

a line connecting the front corner of the collision preventing projections and the intersection of the front surface with the second outer surface being spaced from an intersection of the front surface with the first outer surface by a minimum distance F1 selected to satisfy a relational expression:

$$F1<B.$$

15. A connector, comprising:

a first housing with a receptacle having an opening, the receptacle having opposite first and second surfaces defining a height H for the receptacle, a guiding groove formed in the first surface of the receptacle, first terminals mounted in the first housing and having front ends projecting into the receptacle, the front ends of the first terminals being spaced rearwardly from the opening by a distance B;

a second housing having a main portion with a front surface, first and second outer surfaces extending rearward from the front surface and being dimensioned for insertion into the receptacle of the first housing when the first and second housings are aligned at a proper connecting posture, first and second collision preventing projections formed respectively on the first and second outer surfaces on the second housing reward of the front surface of the main portion, the first and second collision preventing projections formed respectively with first and second front corners spaced outwardly from the respective first and second outer surfaces, the first and second front corners being spaced from one another by a distance E2 selected to satisfy a relational expression:

$$E2>H$$

a line connecting the front corners being spaced from an intersection of the front surface with the first outer surface by a minimum distance F2 selected to satisfy:

$$F2<B.$$

* * * * *